US010726969B2

(12) United States Patent
Iwasaki et al.

(10) Patent No.: US 10,726,969 B2
(45) Date of Patent: Jul. 28, 2020

(54) MULTILAYER INSULATED WIRE AND MULTILAYER INSULATED CABLE

(71) Applicant: Hitachi Metals, Ltd., Tokyo (JP)

(72) Inventors: Makoto Iwasaki, Hitachi (JP); Ryutaro Kikuchi, Mito (JP); Tamotsu Kibe, Hitachi (JP); Mitsuru Hashimoto, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/219,089

(22) Filed: Jul. 25, 2016

(65) Prior Publication Data

US 2017/0032867 A1 Feb. 2, 2017

(30) Foreign Application Priority Data

Jul. 27, 2015 (JP) ..... 2015-147541

(51) Int. Cl.
*H01B 3/00* (2006.01)
*H01B 3/30* (2006.01)
(Continued)

(52) U.S. Cl.
CPC ..... *H01B 3/308* (2013.01); *H01B 3/105* (2013.01); *H01B 3/307* (2013.01); *H01B 3/427* (2013.01);
(Continued)

(58) Field of Classification Search
CPC ..... H01B 3/308
(Continued)

(56) References Cited

U.S. PATENT DOCUMENTS 4,062,998 A * 12/1977 Hagiwara ..... H01B 3/443 428/380
2012/0292077 A1* 11/2012 Sugita ..... C08F 255/02 174/110 SR
(Continued)

FOREIGN PATENT DOCUMENTS

CN 103897323 A 7/2014
JP S52-32589 A 3/1977
(Continued)

OTHER PUBLICATIONS

Chinese Office Action dated Mar. 11, 2019, in Chinese Patent Application No. 201610565679.8 with an English translation.
(Continued)

*Primary Examiner* — Matthew D Matzek
(74) *Attorney, Agent, or Firm* — McGinn I. P. Law Group, PLLC.

(57) ABSTRACT

A multilayer insulated wire includes a conductor, an inner insulation layer, and an outer insulation layer. A gel fraction of the inner insulation layer defined below is not less than 80%. A gel fraction of the outer insulation layer defined below is less than the gel fraction of the inner insulation layer and not less than 75%. An insulation covering layer including the inner and outer insulation layers is cross-linked and has a tensile modulus of not less than 500 MPa in a tensile test conducted at a tensile rate of 200 mm/min. Gel fraction (%)=(mass of inner or outer insulation layer after being immersed in xylene at 110° C. for 24 hours, then left at 20° C. and atmospheric pressure for 3 hours and vacuum-dried at 80° C. for 4 hours/mass of inner or outer insulation layer before immersion in xylene)×100

19 Claims, 1 Drawing Sheet

(51) Int. Cl.

| | |
|---|---|
| ***H01B 3/44*** | (2006.01) |
| ***H01B 3/42*** | (2006.01) |
| ***H01B 3/10*** | (2006.01) |
| ***H01B 7/295*** | (2006.01) |
| *H01B 7/02* | (2006.01) |

(52) U.S. Cl.
CPC ..... *H01B 3/441* (2013.01); *H01B 3/447* (2013.01); *H01B 7/295* (2013.01); *H01B 7/0216* (2013.01)

(58) Field of Classification Search
USPC ..... 174/110 R, 120 R; 428/357, 364, 373, 428/375, 378
See application file for complete search history.

(56) References Cited

U.S. PATENT DOCUMENTS

| | | | | |
|---|---|---|---|---|
| 2013/0240239 | A1* | 9/2013 | Kimura | C09K 21/14 174/110 S |
| 2014/0182883 | A1* | 7/2014 | Sugita | H01B 3/447 174/113 R |

FOREIGN PATENT DOCUMENTS

| | | | |
|---|---|---|---|
| JP | S 52-032589 | A | 3/1977 |
| JP | S52-48084 | A | 4/1977 |
| JP | S 52-48084 | A | 4/1977 |
| JP | 2012-119087 | A | 6/2012 |

OTHER PUBLICATIONS

Japanese Office Action dated Jan. 29, 2019, in couterpart Japanese Patent Application No. 2015-147541, with an English translation thereof.
Chinese Office Action, dated Oct. 8, 2018, in Chinese Application No. 201610565679.8 and English translation thereof.
Japanese Office Action, dated Oct. 30, 2018, in Japanese Application No. 2015-147541 and English translation thereof.
Chinee Office Action, dated Sep. 3, 2019, in Chinese Patent Application No. 201610565679.8 and English Translation thereof.
Japanese Office Action, dated Feb. 6, 2020, in Japanese Application No. 2019-053984 and English Translation thereof.
Chinese Office Action dated May 7. 2020 with an English translation.

* cited by examiner

MULTILAYER INSULATED WIRE AND MULTILAYER INSULATED CABLE

The present application is based on Japanese patent application No. 2015-147541 filed on Jul. 27, 2015, the entire contents of which are incorporated herein by reference.

BACKGROUND OF THE INVENTION

1. Field of the Invention

The invention relates to a multilayer insulated wire and a multilayer insulated cable.

2. Description of the Related Art

Electric wires and cables used in railroad vehicles, automobiles and machines etc. are required to have, if necessary, high abrasion resistance, anti-cut-through property, low-temperature performance and flame retardancy etc.

Among these properties, the anti-cut-through property is a property that a wire covering material is not damaged even when a wire is strongly pressed against a metal edge etc. of a distribution board etc. at the time of wiring, and it is essential in the application mentioned above.

In order to increase the anti-cut-through property, it is necessary to select a highly crystalline material having a high elastic modulus such as engineering plastic (see JP-A-2012-119087).

SUMMARY OF THE INVENTION

The engineering plastic is expensive and difficult to handle since an optimum extrusion condition thereof is likely to be narrowly limited due to a fast crystallization speed thereof.

Another method may be selected which uses a cross-linked polyolefin having a low elastic modulus. In this method, it is possible to obtain a high anti-cut-through property due to dispersion in stress applied to the edge of a cut-through test, but a sufficient abrasion resistance may not be obtained.

It is an object of the invention to provide a multilayer insulated wire and a multilayer insulated cable that are excellent in the abrasion resistance as well as a high anti-cut-through property.

[1] According to an embodiment of the invention, a multilayer insulated wire comprises:

a conductor;

an inner insulation layer that covers the conductor and comprises a resin composition comprising a polyolefin as a main component; and an outer insulation layer that covers the inner insulation layer and comprises a resin composition comprising a polyolefin as a main component, wherein a gel fraction of the inner insulation layer defined below is not less than 80%, wherein a gel fraction of the outer insulation layer defined below is less than the gel fraction of the inner insulation layer and not less than 75%, and wherein an insulation covering layer comprising the inner and outer insulation layers is cross-linked and has a tensile modulus of not less than 500 MPa in a tensile test conducted at a tensile rate of 200 mm/min.

Gel fraction (%)=(mass of inner or outer insulation layer after being immersed in xylene at 110° C. for 24 hours, then left at 20° C. and atmospheric pressure for 3 hours and vacuum-dried at 80° C. for 4 hours/mass of inner or outer insulation layer before immersion in xylene)×100

[2] The multilayer insulated wire according to [1] may be wherein the resin composition of the inner insulation layer comprises a copolymer of a peroxide and/or a polyolefin and an organic unsaturated silane.

[3] The multilayer insulated wire according to [1] or [2] may be wherein the resin composition of the inner insulation layer comprises a high-density polyethylene, an ethylene-ethyl acrylate-maleic anhydride terpolymer, an ethylene-ethyl acrylate copolymer and a trimethylolpropane trimethacrylate.

[4] The multilayer insulated wire according to any one of [1] to [3] may be wherein the gel fraction of the outer insulation layer is by not less than 3% lower than the gel fraction of the inner insulation layer.

[5] The multilayer insulated wire according to any one of [1] to [4] may be wherein the resin composition of the outer insulation layer comprises a high-density polyethylene, an ethylene-ethyl acrylate-maleic anhydride terpolymer and an ethylene-ethyl acrylate copolymer.

[6] The multilayer insulated wire according to any one of [1] to [5] may be wherein the insulation covering layer comprises a magnesium hydroxide and/or an aluminum hydroxide as a flame retardant.

[7] According to another embodiment of the invention, a multilayer insulated cable comprises the multilayer insulated wire according to any one of [1] to [6], and a sheath covering a periphery of the multilayer insulated wire.

Effects of the Invention

According to an embodiment of the invention, a multilayer insulated wire and a multilayer insulated cable that are excellent in the abrasion resistance as well as a high anti-cut-through property.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Insulated Wire

Figure 1:
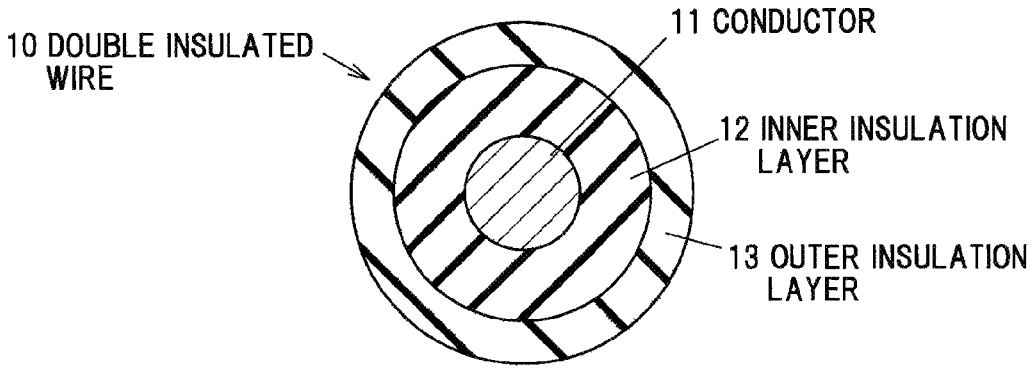
FIG. 1 is a cross sectional view showing an embodiment of a multilayer insulated wire of the present invention.

FIG. 1 is a cross sectional view showing an embodiment of a multilayer insulated wire of the invention.

A double insulated wire 10 in the present embodiment shown in FIG. 1 is provided with a conductor 11 formed of a general material such as tin-plated copper, an inner insulation layer 12 covering the conductor 11 and an outer insulation layer 13 covering the inner insulation layer 12. The inner insulation layer 12 and the outer insulation layer 13 are formed of resin compositions containing a polyolefin as a major component.

An insulation covering, which is composed of the inner insulation layer 12 and the outer insulation layer 13, can be formed by, e.g., co-extrusion molding and is cross-linked after the molding. The applicable cross-linking methods are, e.g., chemical cross-linking using organic peroxide, radiation cross-linking using electron beam, and silane cross-linking using a copolymer with organic unsaturated silane. Of those, electron beam radiation cross-linking which can be used regardless of the size of wire is preferable.

The gel fraction of the inner insulation layer 12 defined by the following expression is not less than 80%, preferably not less than 83%, more preferably not less than 85%. On the other hand, the gel fraction of the outer insulation layer 13 defined by the following expression is less than the gel fraction of the inner insulation layer but is not less than 75%. The gel fraction of the outer insulation layer 13 is preferably not less than 3% lower, preferably not less than 5% lower than the gel fraction of the inner insulation layer 12.

Gel fraction (%)=(mass of inner or outer insulation layer after being immersed in xylene at 110° C. for 24 hours, then left at 20° C. and atmospheric pressure for 3 hours and vacuum-dried at 80° C. for 4 hours/mass of inner or outer insulation layer before immersion in xylene)×100

The "mass of inner or outer insulation layer" in the expression means the mass of the inner insulation layer when calculating the gel fraction of the inner insulation layer, and the mass of the outer insulation layer when calculating the gel fraction of the outer insulation layer.

When the gel fraction of the inner insulation layer 12 is less than 80% and the gel fraction of the outer insulation layer 13 is less than 75%, it is not possible to obtain sufficient wear characteristics. Meanwhile, better anti-cut-through property is obtained when the gel fraction of the outer insulation layer 13 is lower than that of the inner insulation layer 12. In other words, satisfactory anti-cut-through property cannot be obtained when the gel fraction of the outer insulation layer 13 is higher than that of the inner insulation layer 12. The gel fraction of the outer insulation layer 13 is reduced in order to increase flexibility of the outer layer, so that stress applied by a cut-through edge can be dispersed.

The method of increasing the gel fraction of the inner insulation layer 12 is, e.g., addition of multifunctional monomer, peroxide or silane-grafted polyolefin to the material constituting the inner insulation layer 12. When using such a method, the gel fraction of the inner insulation layer 12 can be easily increased by exposure to electron beam.

As the multifunctional monomer, it is preferable to use e.g., trimethylolpropane trimethacrylate or trimethylolpropane triacrylate. The amount of the multifunctional monomer to be added is preferably 3 to 15 parts by mass, more preferably 5 to 10 parts by mass per 100 parts by mass of polyolefin as the major component.

As the peroxide, it is preferable to use e.g., dialkyl peroxide or alkyl peroxyester. The amount of the peroxide to be added is preferably 0.01 to 1 part by mass, more preferably 0.03 to 0.1 parts by mass per 100 parts by mass of polyolefin as the major component.

As the silane-grafted polyolefin, it is preferable to use e.g., silane-grafted high-density polyethylene.

The insulation covering composed of the inner insulation layer 12 and the outer insulation layer 13 has a tensile modulus of not less than 500 MPa in a tensile test conducted at a tensile rate (a displacement rate) of 200 mm/min. The tensile modulus of not less than 530 MPa is preferable. The tensile modulus of not less than 600 MPa is more preferable since flaws are less likely to occur on the wire surface. Enough abrasion resistance is not obtained with tensile modulus of less than 500 MPa. The tensile modulus is measured at a temperature of 15 to 30° C. and a strain of 0.1 to 3%.

Polyolefin used as the insulation material for the inner insulation layer 12 and the outer insulation layer 13 only needs to be capable of providing the above-mentioned properties, and specific examples thereof include high-density polyethylene, medium-density polyethylene, low-density polyethylene, very low-density polyethylene, ethylene-acrylic ester copolymer, ethylene-vinyl acetate copolymer, ethylene-propylene copolymer, ethylene-octene copolymer, ethylene-butene copolymer and butadiene-styrene copolymer, etc. These materials may be modified with maleic anhydride, and examples of such materials include ethylene-acrylic ester-maleic anhydride terpolymer, etc. It is also possible to use the previously mentioned silane-grafted polyolefin. These materials may be used alone or may be used as a mixture of two or more.

Among those materials, preferably one or more, more preferably two or more, further preferably all of high-density polyethylene, ethylene-ethyl acrylate-maleic anhydride terpolymer and ethylene-ethyl acrylate copolymer are used. The high-density polyethylene used as a material of the inner insulation layer 12 is preferably a silane-grafted high-density polyethylene.

Among polyolefins, polypropylene is not preferable since ability of accepting flame retardant such as magnesium hydroxide is low due to high crystallinity, it is difficult to perform peroxide cross-linking due to requiring high processing temperature, and it is also difficult to perform radiation cross-linking since it is destroyed by exposure to electron beam. Also, styrene-based thermoplastic elastomer is not preferable due to having poor embrittlement characteristics.

In the present embodiment, polymer components other than those listed above may be contained as long as the effects of the embodiment are exerted, but the amount of the above-listed polyolefins contained in the total polymer is preferably not less than 70 mass %, more preferably not less than 80 mass %, further preferably not less than 90 mass %.

It is preferable that a flame retardant be added to the material of the insulation covering. Any flame retardant can be used as long as it is halogen-free. Magnesium hydroxide and aluminum hydroxide, which are metal hydroxides, are particularly preferable and can be used alone or in combination. Magnesium hydroxide is further preferable since dehydration reaction mainly occurs at as high as 350° C. and excellent flame retardancy is obtained.

Other specific applicable halogen-free flames retardants include clay, silica, zinc stannate, zinc borate, calcium borate, dolomite hydroxide and silicone, etc. In view of dispersibility, etc., the flame retardant can be surface-treated with a silane coupling agent, a titanate coupling agent or a fatty acid such as stearic acid.

Phosphorus-based flame retardants such as red phosphorus and triazine-based flame retardants such as melamine cyanurate are not suitable since phosphine gas or cyanogen gas which are harmful to humans are produced.

The amount of the flame retardant to be added to the material of the insulation covering is not specifically limited, but is preferably, e.g., not less than 150 parts by mass per 100 parts by mass of polyolefin as the major component since it is possible to obtain high flame retardancy.

To the resin composition composed of such materials, it is possible, if necessary, to add cross-linking agent, cross-linking aid, flame retardant, flame-retardant aid, ultraviolet absorber, light stabilizer, softener, lubricant, colorant, reinforcing agent, surface active agent, inorganic filler, antioxidant, plasticizer, metal chelator, foaming agent, compatibilizing agent, processing aid and stabilizer, etc.

The double insulated wire 10 may be provided with a braided wire, etc., if necessary.

The insulation covering is composed of two layers in the embodiment of the invention but may have a multilayer structure composed of three or more layers. For example, the inner insulation layer 12 may have a multilayer structure composed of two or more layers, or the outer insulation layer 13 may have a multilayer structure composed of two or more layers.

Cable

Figure 2:
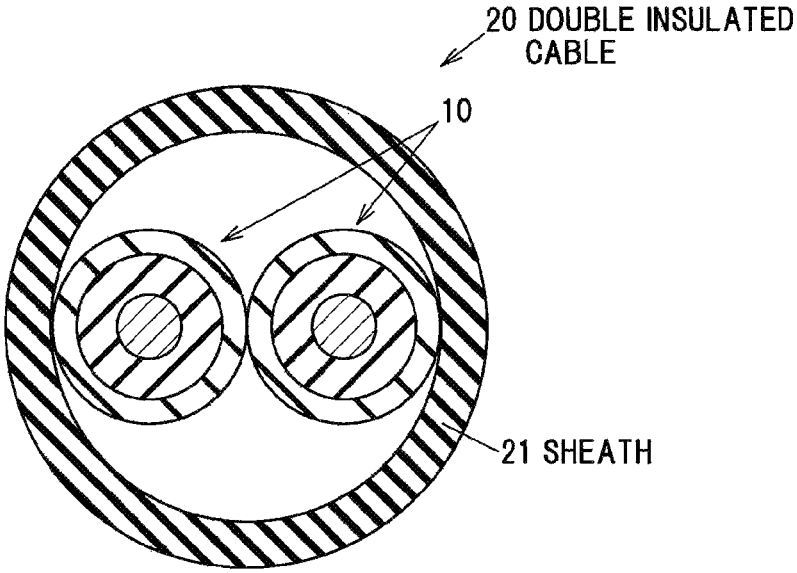
FIG. 2 is a cross sectional view showing an embodiment of a multilayer insulated cable of the invention.

FIG. 2 is a cross sectional view showing an embodiment of a multilayer insulated cable of the invention.

A double insulated cable 20 in the present embodiment shown in FIG. 2 is provided with the double insulated wire(s) 10 in the embodiment of the invention and a sheath 21 covering the double insulated wire(s) 10.

In the present embodiment, the double insulated cable 20 is provided with a two-core twisted wire formed by twisting two double insulated wires 10 together and the sheath 21 formed around the two-core twisted wire. The insulated wire may be a single core wire or a multi-core twisted wire other than two-core. Additionally, metal braid, glass braid or separator, etc., may be provided if necessary.

The material of the sheath 21 is not specifically limited, and is preferably cross-linked after being molded.

EXAMPLES

Next, the invention will be described in more detail in reference to Examples. However, the following examples are not intended to limit the invention in any way.

Examples and Comparative Examples

The double insulated wire 10 shown in FIG. 1 was made as follows.

(1) A tin-plated conductor (37 strands/0.18 mm diameter) was used as the conductor 11.

(2) Resin compositions formed by mixing and kneading components shown in Tables 1 and 2 using a 14-inch open roll mill were pelletized by a granulator, thereby obtaining an outer layer material and an inner layer material.

(3) The obtained inner and outer layer materials were co-extruded directly on the tin-plated conductor using a 40-mm extruder so that the inner layer had a thickness of 0.1 mm and the outer layer had thickness of 0.16 mm, thereby providing the inner insulation layer 12 on the conductor 11 and the outer insulation layer 13 directly on the inner insulation layer 12.

(4) The obtained insulated wires were cross-linked by exposure to electron beam. The radiation doses are shown in Table 1.

The used materials shown in Table 1 are as follows:

(1) High-density polyethylene (HDPE): Hi-ZEX 5305E, manufactured by Prime Polymer Co., Ltd.

(2) Ethylene-ethyl acrylate-maleic anhydride terpolymer (M-EEA): BONDINE LX4110, manufactured by Arkema (3) Ethylene-ethyl acrylate copolymer (EEA): Rexpearl A1150, manufactured by Japan polyethylene Corporation (4) Trimethylolpropane trimethacrylate (TMPT): TMPT manufactured by Shin Nakamura Chemical Co., Ltd.

(5) Silane-grafted high-density polyethylene (Si-HDPE): LINKLON QS241HZ (catalyst: LZ015H), manufactured by Mitsubishi Chemical Corporation, a QS241HZ/LZ015H mixture ratio=19/1

(6) Peroxide: Perbutyl P (dialkyl peroxide), manufactured by NOF Corporation

The gel fraction and tensile modulus were measured on the obtained insulated wires. The measurement results are shown in Table 1.

(1) Gel Fraction

The inner insulation layer 12 was separated from the outer insulation layer 13 by cutting using a knife. Each layer was preliminarily weighed and was then immersed in xylene heated to 110° C. for 24 hours. A ratio of the mass of each layer which was left at 20° C. and atmospheric pressure for 3 hours after the immersion and vacuum-dried at 80° C. for 4 hours, with respect to the mass of each layer before immersion in xylene (the percentage when calculated using the latter as a denominator) was derived as a gel fraction.

The gel fraction before cross-linking (before exposure to electron beam) was also derived in the same manner.

(2) Tensile Test

The insulation coverings after pulling out the conductors 11 were subjected to the tensile test conducted at a tensile rate of 200 mm/min to measure the tensile modulus. In more precise, the tensile modulus was measured at a temperature of 23° C. and strain of 0.2 to 0.3% in accordance with JIS K 7161.

The obtained insulated wires were evaluated by various evaluation tests described below. The evaluation results are shown in Table 1.

(1) Cut-Through Test

Evaluation of anti-cut-through property was conducted in accordance with EN 50305 Clause 5.6. The samples passed the test (○) when the insulation broke at a load of not less than 70N, and failed the test (x) when the insulation broke at a load of less than 70N.

(2) Abrasion Test

Evaluation of abrasion resistance was conducted in accordance with EN 50305 Clause 5.2. The samples passed the test (○) when worn out with not less than 150 cycles of abrasion, and failed the test (x) when worn out with less than 150 cycles.

(3) Flame-Retardant Test 600 mm-long insulated wires were held vertical and a flame of a Bunsen burner was applied thereto for 60 seconds. The wires with a char length of less than 300 mm after removing the flame passed the test (◎: excellent), the wires with a char length of not less than 300 mm and less than 400 mm also passed the test (○: good), the wires with a char length of not less than 400 mm and less than 450 mm also passed the test (Δ: acceptable), and the wires with a char length of not less than 450 mm failed the test (x).

(4) Overall Evaluation

The overall evaluation was rated as "Pass (◎)" when all evaluation results in the above tests were "◎" or "○", rated as "Pass (○)" when "Δ" was included, and rated as "Fail (x)" when "x" was included.

TABLE 1

Examples and Comparative Examples (mixed amount: parts by mass)

| Items | | Examples | | | | |
|---|---|---|---|---|---|---|
| | | Example | | | Comparative Example | |
| | | 1 | 2 | 3 | 1 | 2 |
| Outer insulation layer | HDPE[1)] | 40 | 40 | 40 | 40 | 40 |
| | M-EEA[2)] | 30 | 30 | 30 | 30 | 30 |
| | EEA[3)] | 30 | 30 | 30 | 30 | 30 |
| | TMPT[4)] | 0 | 8 | 8 | 8 | 0 |
| | Flame retardants and otheres 1 (Table 2) | 153 | 153 | 153 | 153 | 153 |
| Inner insulation layer | HDPE[1)] | 40 | 0 | 40 | 40 | 40 |
| | Si-HDPE[5)] | 0 | 40 | 0 | 0 | 0 |
| | M-EEA[2)] | 30 | 30 | 30 | 30 | 30 |
| | EEA[3)] | 30 | 30 | 30 | 30 | 30 |
| | TMPT[4)] | 8 | 8 | 8 | 0 | 8 |
| | Peroxide[6)] | 0 | 0 | 0.05 | 0 | 0 |
| | Flame retardants and otheres 2 (Table 2) | 158 | 158 | 158 | 158 | 158 |
| Electron radiation dose (Mrad) | | 15 | 15 | 15 | 15 | 5 |
| Gel fraction (%) before cross-linking | Outer insulation layer | 1 | 3 | 3 | 3 | 2 |
| | Inner insulation layer | 2 | 4 | 4 | 1 | 2 |
| Gel fraction (%) after cross-linking | Outer insulation layer | 75 | 85 | 85 | 85 | 63 |
| | Inner insulation layer | 85 | 91 | 92 | 75 | 72 |
| Tensile modulus (MPa), not less than 500 MPa | | 540 | 600 | 610 | 570 | 420 |
| Evaluation | Cut-through test (N) | 73 | 76 | 77 | 68 | 43 |
| | Judgement | ○ | ○ | ○ | X | X |
| | Abrasion test (cycles of abrasion) | 370 | 480 | 490 | 410 | 110 |
| | Judgement | ○ | ○ | ○ | ○ | X |
| | Char length (mm) in Flame-retardant test | 50 | 50 | 50 | 50 | 50 |
| | Judgement | ◎ | ◎ | ◎ | ◎ | ◎ |
| | Overall evaluation | ◎ | ◎ | ◎ | X | X |

[1)]Hi-ZEX 5305E from Prime Polymer,
[2)]BONDINE LX4110 from Arkema,
[3)]Rexpearl A1150 from Japan polyethylene,
[4)]TMPT (Trimethylolpropane trimethacrylate) from Shin Nakamura Chemical,
[5)]LINKLON QS241HZ (catalyst: LZ015H) from Mitsubishi Chemical,
[6)]Perbutyl P (dialkyl peroxide) from NOF

TABLE 2

Flame retardants and others

| | Product name | Manufacturer | Added amount (parts by mass) |
|---|---|---|---|
| Flame retardants and others 1 | Magnesium hydroxide (Kisuma 5L) | Kyowa Chemical | 150 |
| | Pentaerythritol tetrakis[3-(3,5-di-tert-butyl-4-hydroxyphenyl)propionate] (Irganox 1010) | BASF | 2 |
| | Zinc stearate (SZ-P) | Sakai Chemical Industry | 1 |
| | Total | | 153 |
| Flame retardants and others 2 | Magnesium hydroxide (Kisuma 5L) | Kyowa Chemical | 150 |
| | Pentaerythritol tetrakis[3-(3,5-di-tert-butyl-4-hydroxyphenyl)propionate] (Irganox 1010) | BASF | 2 |
| | Bis[3-(dodecylthio)propionic acid]2,2-bis[[3-(dodecylthio)-1-oxopropyloxy]methyl]-1,3-propanediyl (AO-412S) | ADEKA | 1 |
| | Decamethylene dicarboxylic acid disalicyloyl hydrazide (CDA-6) | ADEKA | 4 |
| | Zinc stearate (SZ-P) | Sakai Chemical Industry | 1 |
| | Total | | 158 |

In Examples 1 to 3, all evaluation results were "◎" or "○" as shown in Table 1 and the overall evaluation was thus rated as "Pass (◎)".

In Comparative Example 1, since the gel fraction of the inner insulation layer was less than 80% and was higher than that of the outer insulation layer as shown in Table 1, the result for anti-cut-through property was Fail (x). Therefore, the overall evaluation was rated as "Fail (x)".

In Comparative Example 2, since the gel fraction of the inner insulation layer was less than 80%, the gel fraction of the outer insulation layer was less than 75% and the tensile modulus was less than 500 MPa as shown in Table 1, the results for anti-cut-through property and antiwear property were Fail (x). Therefore, the overall evaluation was rated as "Fail (x)".

The above results show that it is not possible to obtain both the anti-cut-through property and the abrasion resistance without satisfying all of the inner insulation layer with a gel fraction of not less than 80%, the outer insulation layer with a gel fraction of not less than 75%, the lower gel fraction of the inner insulation layer than the outer insulation layer and the tensile modulus of not less than 500 MPa.

The gel fraction of the inner insulation layer before exposure to electron beam was not more than 5% in all of Examples 1 to 3. An increase in the gel fraction of the inner insulation layer after exposure to electron beam was greater in Examples 2 and 3 than in Example 1 even though the radiation dose was the same. It was found from this result that use of a copolymer with peroxide or organic unsaturated silane is an effective method to improve the gel fraction.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A multilayer insulated wire, comprising:

a conductor;

an inner insulation layer that covers the conductor and comprises a resin composition comprising a polyolefin as a main component, the polyolefin in the inner layer being consisted of a combination of ethylene-ethyl acrylate-maleic anhydride terpolymer (M-EEA), ethylene-ethyl acrylate copolymer (EEA), and one selected from the group consisting of high-density polyethylene (HDPE) and silane-grafted high-density polyethylene (Si-HDPE);

an outer insulation layer that covers the inner insulation layer and comprises a resin composition comprising a polyolefin as a main component;

a flame retardant of not less than 150 parts by mass per 100 parts by mass of the polyolefin in the outer insulation layer, wherein the polyolefin in the outer insulation layer comprises a high-density polyethylene, an ethylene-ethyl acrylate-maleic anhydride terpolymer, and an ethylene-ethyl acrylate copolymer, wherein a gel fraction of the inner insulation layer defined below is not less than 85% and not more than 92%, wherein a gel fraction of the outer insulation layer defined below is less than the gel fraction of the inner insulation layer and is not less than 75% and not more than 85%, wherein an insulation covering layer comprising the inner and outer insulation layers is cross-linked and has a tensile modulus of not less than 500 MPa in a tensile test conducted at a tensile rate of 200 mm/min, and wherein the gel fraction is defined as: Gel fraction (%)= (mass of the inner or outer insulation layer after being immersed in xylene at 110° C. for 24 hours, then left at 20° C. and atmospheric pressure for 3 hours and vacuum-dried at 80° C. for 4 hours/mass of the inner or outer insulation layer before immersion in xylene)× 100.

2. The multilayer insulated wire according to claim 1, wherein the resin composition of the inner insulation layer further comprises a copolymer of a peroxide and/or a polyolefin and an organic unsaturated silane.

3. The multilayer insulated wire according to claim 1, wherein the resin composition of the inner insulation layer further comprises a multifunctional monomer.

4. The multilayer insulated wire according to claim 1, wherein the gel fraction of the outer insulation layer is by not less than 3% lower than the gel fraction of the inner insulation layer.

5. The multilayer insulated wire according to claim 1, wherein the insulation covering layer comprises a magnesium hydroxide and/or an aluminum hydroxide as the flame retardant.

6. A multilayer insulated cable, comprising:

the multilayer insulated wire according to claim 1; and a sheath covering a periphery of the multilayer insulated wire.

7. The multilayer insulated wire according to claim 2, wherein the peroxide comprises a dialkyl peroxide or an alkyl peroxyester.

8. The multilayer insulated wire according to claim 2, wherein an amount of the peroxide is 0.01 to 1 part by mass per 100 parts by mass of the polyolefin in the inner insulation layer.

9. The multilayer insulated wire according to claim 3, wherein the multifunctional monomer comprises trimethylolpropane trimethacrylate or trimethylolpropane triacrylate.

10. The multilayer insulated wire according to claim 3, wherein an amount of the multifunctional monomer is 3 to 15 parts by mass per 100 parts by mass of the polyolefin in the inner insulation layer.

11. The multilayer insulated wire according to claim 5, wherein an amount of the flame retardant is not less than 150 parts by mass per 100 parts by mass of the polyolefin in the insulation covering layer.

12. The multilayer insulated wire according to claim 1, wherein the gel fraction of the outer insulation layer is by not less than 5% lower than the gel fraction of the inner insulation layer.

13. The multilayer insulated wire according to claim 1, wherein the gel fraction of the outer insulation layer is by not less than 5% lower than the gel fraction of the inner insulation layer.

14. The multilayer insulated wire according to claim 3, wherein an amount of the multifunctional monomer is 5 to 15 parts by mass per 100 parts by mass of the polyolefin in the inner insulation layer.

15. The multilayer insulated wire according to claim 2, wherein an amount of the peroxide is 0.03 to 1 part by mass per 100 parts by mass of the polyolefin in the inner insulation layer.

16. The multilayer insulated wire according to claim 1, wherein the insulation covering layer has the tensile modulus of not less than 600 MPa in the tensile test conducted at the tensile rate of 200 mm/min, and wherein the resin composition of the inner insulation layer further comprises a flame retardant of not less than 150 parts by mass per 100 parts by mass of the polyolefin.

17. The multilayer insulated wire according to claim 1, wherein the insulation covering layer further comprises magnesium hydroxide as the flame retardant.

18. The multilayer insulated wire according to claim 2, wherein the peroxide comprises a dialkyl peroxide.

19. The multilayer insulated wire according to claim 1, wherein the gel fraction of the inner insulation layer is not less than 91%.

* * * * *